US009379440B2

(12) United States Patent
Onaka et al.

(10) Patent No.: US 9,379,440 B2
(45) Date of Patent: Jun. 28, 2016

(54) ANTENNA DEVICE AND ELECTRONIC APPARATUS

(71) Applicant: MURATA MANUFACTURING CO., LTD., Kyoto (JP)

(72) Inventors: Kengo Onaka, Kyoto (JP); Hiroya Tanaka, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 106 days.

(21) Appl. No.: 14/286,176

(22) Filed: May 23, 2014

(65) Prior Publication Data

US 2014/0300517 A1 Oct. 9, 2014

Related U.S. Application Data

(63) Continuation of application No. PCT/JP2012/080007, filed on Nov. 20, 2012.

(30) Foreign Application Priority Data

Nov. 25, 2011 (JP) ..... 2011-257023

(51) Int. Cl.
*H01Q 1/24* (2006.01)
*H01Q 5/00* (2015.01)
(Continued)

(52) U.S. Cl.
CPC ..... *H01Q 5/0027* (2013.01); *H01Q 1/243* (2013.01); *H01Q 5/307* (2015.01); *H01Q 5/378* (2015.01)

(58) Field of Classification Search
CPC ..... H01Q 5/307; H01Q 5/378; H01Q 1/243
USPC ..... 343/702, 700 MS
See application file for complete search history.

(56) References Cited

U.S. PATENT DOCUMENTS 7,026,999 B2 * 4/2006 Umehara ..... H01Q 1/243 343/700 MS
7,557,761 B2 * 7/2009 Iwai ..... H01Q 9/30 343/702

(Continued)

FOREIGN PATENT DOCUMENTS

JP S63-62402 A 3/1988
JP 2002-076735 A 3/2002

(Continued)

OTHER PUBLICATIONS

Written Opinion of the International Searching Authority; PCT/JP2012/080007; Feb. 5, 2013.

(Continued)

*Primary Examiner* — Hoang V Nguyen
(74) *Attorney, Agent, or Firm* — Studebaker & Brackett PC

(57) ABSTRACT

A first radiation electrode is formed on a bottom surface of a no-ground conductor formation area of a board, and second radiation electrodes are formed on a top surface of the no-ground conductor formation area. A longitudinal electrode of the first radiation electrode is electrically continuous with a ground conductor. A first end portion and a second end portion of a transverse electrode of the first radiation electrode extend toward the ground conductor. The transverse electrode of the first radiation electrode operates as a radiation element for radiating a signal at a first frequency. The second radiation electrodes each operate as a radiation element for radiating a signal at a second frequency, and also as a capacitive feed electrode for the first radiation electrode. This enables to strengthen directivity toward an antenna portion side (forward direction) of the board, and further enables multiband use.

6 Claims, 13 Drawing Sheets

(51) Int. Cl.
*H01Q 5/307* (2015.01)
*H01Q 5/378* (2015.01)

(56) References Cited

U.S. PATENT DOCUMENTS

| | | | | |
|---|---|---|---|---|
| 7,589,680 | B2 * | 9/2009 | Tsai | H01Q 1/2266 343/700 MS |
| 8,462,072 | B2 * | 6/2013 | Andrenko | H01Q 1/38 343/700 MS |
| 2002/0024466 | A1 | 2/2002 | Masuda | |
| 2003/0076264 | A1 | 4/2003 | Yuanzhu | |
| 2004/0108957 | A1 | 6/2004 | Umehara et al. | |
| 2007/0290927 | A1 | 12/2007 | Rowell et al. | |
| 2008/0174508 | A1 | 7/2008 | Iwai et al. | |
| 2008/0258992 | A1 | 10/2008 | Tsai et al. | |
| 2010/0156745 | A1 | 6/2010 | Andrenko et al. | |

FOREIGN PATENT DOCUMENTS

| | | | |
|---|---|---|---|
| JP | 2003-133838 | A | 5/2003 |
| JP | 2004-088218 | A | 3/2004 |
| JP | 2004-201278 | A | 7/2004 |
| JP | 2004-363848 | A | 12/2004 |
| JP | 2006-074446 | A | 3/2006 |
| JP | 2008-199588 | A | 8/2008 |
| JP | 2010-153973 | A | 7/2010 |
| WO | 2008/000175 | A1 | 1/2008 |

OTHER PUBLICATIONS

An Office Action; "Notice of Reasons for Rejection," issued by the Japanese Patent Office on Mar. 31, 2015, which corresponds to Japanese Patent Application No. 2013-545919 and is related to U.S. Appl. No. 14/286,176; with English language translation.

International Search Report; PCT/JP2012/080007; Feb. 5, 2013.

* cited by examiner

ANTENNA DEVICE AND ELECTRONIC APPARATUS

CROSS REFERENCE TO RELATED APPLICATIONS

This application claims benefit of priority to Japanese Patent Application 2011-257023 filed Nov. 25, 2011, and to International Patent Application No. PCT/JP2012/080007 filed on Nov. 20, 2012, the entire content of each of which is incorporated herein by reference.

TECHNICAL FIELD

The present technical field relates to antenna devices and electronic apparatuses including the antenna devices and, more particularly, to antenna devices and electronic apparatuses for use in wireless communication or the like in multiple frequency bands.

BACKGROUND

In recent years, more and more wireless communication modules to be stored inside electronic apparatuses or wireless communication apparatuses such as cellular phones and the like have adopted a configuration in which plural antennas are formed on a single wireless communication apparatus. Particularly, in small size wireless communication apparatuses, a footprint of antenna portion in the wireless communication apparatus is reduced in order to downsize a built-in wireless communication system. Thus, it becomes more common to adopt the configuration in which plural antennas are mounted on a single printed board together with a wireless communication module.

Japanese Unexamined Patent Application Publication No. 2006-74446 describes a multiband antenna device in which two chip antennas are mounted on a printed board. FIG. 17(A) is a plan view of the antenna device described in Japanese Unexamined Patent Application Publication No. 2006-74446, and FIG. 17(B) is its bottom view. Two chip antennas 106 and 107 are mounted on a top surface of a printed board 102 inside mounting areas 108 and 109 that do not overlap a ground conductor portion 104. The ground conductor portion 104 includes a second ground conductor portion 104b that is extended by a predetermined length from a first ground conductor portion 104a in a direction toward an end portion, and a third ground conductor portion 104c and a fourth ground conductor portion 104d that are extended from the second ground conductor portion 104b in directions toward sides where the chip antennas 106 and 107 are located.

SUMMARY

Technical Problem

In the antenna device of Japanese Unexamined Patent Application Publication No. 2006-74446 illustrated in FIG. 17, isolation between two antennas is increased by arranging the two chip antennas and a T-shaped ground conductor portion (ground electrode) at one side of the printed board in a length direction, making it possible to suppress unwanted mutual coupling. Further, directivity may be controlled by the shape of the T-shaped ground conductor portion.

However, in the antenna device of Japanese Unexamined Patent Application Publication No. 2006-74446 illustrated in FIG. 17, there are following problems.

(1) Multiband Use

As an antenna for a Multiple Input Multiple Output (MIMO) system or diversity, the antenna only can be used in a single band. Japanese Unexamined Patent Application Publication No. 2006-74446 describes an example for use at 2.4 GHz and 5 GHz. However, this uses two antennas assigned to different bands, and the two chip antennas are not operated in the same frequency band. Such a problem arises because the resonant frequency of antenna needs to be set up for each band to use.

(2) Antenna Element Mounting Area Limitation

Japanese Unexamined Patent Application Publication No. 2006-74446 describes that the chip antennas have to be mounted so as not to overlap the ground conductor 104 in order to increase radiation efficiency. In other words, the smaller an antenna area on the printed board becomes, the further the mounting area of chip antenna is limited. This poses a constraint on the feeding location and the antenna size.

(3) Directivity

In the antenna device 100 of Japanese Unexamined Patent Application Publication No. 2006-74446 illustrated in FIG. 17, the directivity is weak in a direction from the first ground conductor portion 104a to the T-shaped ground conductor portion. When the antenna device 100 is installed in, for example, a TV, a Blu-ray Disc (registered trademark) player/recorder, or the like, it is to be expected that the antenna device 100 is mounted in the front of the apparatus with the antenna portion being directed forward. However, the foregoing directivity may not allow a signal to be transmitted forward from the front of the apparatus, and there is a possibility that the directivity may become stronger in a range from a transverse direction to a backward direction. Typically, the apparatus such as a TV, a BDP, or a BDR is placed so that the apparatus faces a center of a room while the backside thereof being at a wall side. For example, there may be a case where throughput of communication with another apparatus could not be increased as expected in WiFi (registered trademark) data exchange.

Particularly, in a 2.4 GHz band, there are many noise sources such as a microwave oven, a cordless phone, and the like. Further, the number of channels is small (practically three channels and a frequency band overlaps with another one of an adjacent channel), and, due to explosive growth of WiFi (registered trademark) data exchange, interference troubles are occurring among users. In a 5 GHz band, the antenna device is susceptive to noise from products themselves (hard disk drive, HDMI (registered trademark) audio/video interface, and the like). Thus, it is important to control the directivity.

Thus, an object of the present disclosure is to provide an antenna device that has a higher directivity toward an antenna portion side (forward direction) of a board and enables multiband use, and to provide an electronic apparatus including such an antenna device.

Solution to Problem (1) An antenna device of the present disclosure includes a board that includes a ground conductor formation area in which a ground conductor is formed and a no-ground conductor formation area in which no ground conductor is formed, and is characterized in that:

a first radiation electrode and a second radiation electrode are included in the no-ground conductor formation area, the first radiation electrode being T-shaped and including a transverse electrode extending in a first direction and a longitudinal electrode protruding from the middle of the transverse electrode in a direction orthogonal to the first direction, the second radiation electrode being arranged near the transverse electrode of the first radiation electrode;

the first radiation electrode has a length that enables it to operate as a radiation element for radiating a signal at a first frequency (that is a low frequency side);

the longitudinal electrode of the first radiation electrode is electrically continuous with the ground conductor or faces the ground conductor over a slit;

the second radiation electrode has a length that enables it to operate as a radiation element for radiating a signal at a second frequency (that is a high frequency side);

the second radiation electrode is connected to a feed port; and the second radiation electrode forms a capacitance with the first radiation electrode and performs capacitive feeding of a signal at the first frequency for the first radiation electrode.

(2) Preferably, the first radiation electrode may be disposed at a location so that a capacitance is formed between the ground conductor and an end portion of the transverse electrode of the first radiation electrode.

(3) Preferably, the first radiation electrode may be formed on a first surface of the board, and the second radiation electrode may be formed on a second surface thereof.

(4) Preferably, a stub extending from the ground conductor may be formed on a surface of the board opposite to the first radiation electrode.

(5) Preferably, the second radiation electrode may be disposed at a location so that a capacitance is formed between the second radiation electrode and the longitudinal electrode of the first radiation electrode.

(6) Preferably, two units of the second radiation electrode may be used. Further, the two units of the second radiation electrode may be connected to individual feed ports. The two units of the second radiation electrode each form a capacitance with the first radiation electrode, and each perform capacitive feeding of a signal at the first frequency for an end portion of the transverse electrode of the first radiation electrode.

(7) An electronic apparatus of the present disclosure includes the antenna device described in anyone of (1) to (6), and is characterized in that the antenna device is stored inside the electronic apparatus so that a direction from the ground conductor formation area to the transverse electrode of the foregoing T-shaped electrode matches a forward direction of the electronic apparatus.

Advantageous Effects of Disclosure

Accordingly, the present disclosure enables to configure an antenna device that has a higher directivity in an end portion (antenna portion) direction when viewed from a center of the board and enables multiband use, and to configure an electronic apparatus including such an antenna device.

DETAILED DESCRIPTION

Embodiments of the present disclosure are illustrated in a plurality of specific embodiments with reference to the drawings.

First Embodiment

Figure 1:
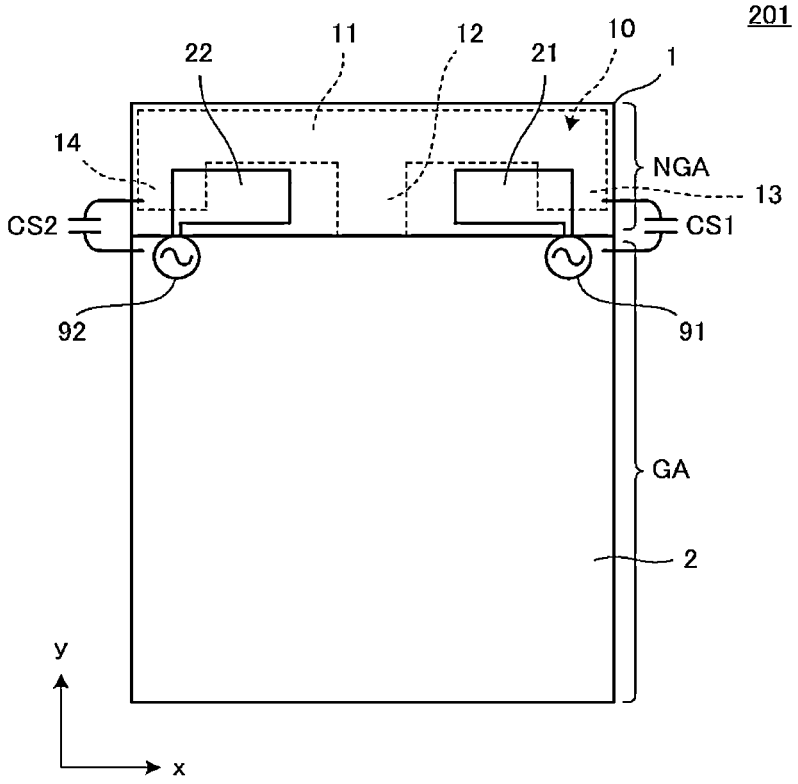
FIG. 1 is a plan view of a communication module 201 including an antenna device according to a first embodiment.

FIG. 1 is a plan view of a communication module 201 including an antenna device according to the first embodiment. The communication module 201 includes a board 1 that includes a ground conductor formation area GA and a no-ground conductor formation area NGA. The ground conductor formation area GA is an area where a ground conductor 2 is formed on both surfaces of the board 1. The ground conductors 2 at both surfaces are connected at plural points via through-hole conductors (not illustrated in the figure). The no-ground conductor formation area NGA is an area where a no ground conductor is formed on both surfaces of the board 1.

A first radiation electrode 10 is formed on a first surface (bottom surface) of the no-ground conductor formation area NGA of the board 1, and a right-side second radiation electrode 21 and a left-side second radiation electrode 22 are formed on a second surface (top surface) of the no-ground conductor formation area NGA.

The first radiation electrode 10 includes a transverse electrode 11 extending in a first direction and a longitudinal electrode 12 protruding from the middle (center) of this transverse electrode in a direction orthogonal to the first direction. The longitudinal electrode 12 and the ground conductor 2 are electrically continuous. A first end portion 13 and a second end portion 14 of the transverse electrode 11 of the first radiation electrode 10 extend toward the ground conductor 2. Thus, a stray capacitance CS1 is formed between opposed portions of the first end portion 13 and the ground conductor 2, and a stray capacitance CS2 is formed between opposed portions of the second end portion 14 and the ground conductor 2.

The right-side second radiation electrode 21 is arranged near the first end portion 13 of the transverse electrode 11 of the first radiation electrode 10 whereas the left-side second radiation electrode 22 is arranged near the second end portion 14 of the transverse electrode 11 of the first radiation electrode 10. The board 1 has an x-axis direction width of 35 mm, a y-axis direction length of 45 mm, and a thickness of 1.2 mm. Further, the size of antenna portion (no-ground conductor formation area) is 35 mm in the x-axis direction and 10 mm in the y-axis direction.

The first radiation electrode 10 (particularly, transverse electrode 11) has a length that enables it to operate as a radiation element for radiating a signal at a first frequency, or a frequency at a low frequency side. The right-side second radiation electrode 21 and the left-side second radiation electrode 22 each have a length that enables them to operate as a radiation element for radiating a signal at a second frequency, or a frequency at a high frequency side.

One corner of the right-side second radiation electrode 21 is a feed port, to which a first feed circuit 91 is connected. Similarly, one corner of the left-side second radiation electrode 22 is a feed port, to which a second feed circuit 92 is connected. In FIG. 1, the feed circuits 91 and 92 are each represented by symbols.

The right-side second radiation electrode 21 performs capacitive feeding for the first radiation electrode 10 by forming a capacity with the first end portion 13 of the transverse electrode 11 of the first radiation electrode 10. Similarly, the left-side second radiation electrode 22 performs capacitive feeding for the first radiation electrode 10 by forming a capacity with the second end portion 14 of the transverse electrode 11 of the first radiation electrode 10.

FIG. 2(A) is a diagram illustrating a current distribution when feeding a signal at the first frequency, or the frequency at the low frequency side. FIG. 2(B) is a diagram illustrating a current distribution when feeding a signal at the second frequency, or the frequency at the high frequency side. In both cases, examples are employed in which the feeding is performed from the first feed circuit 91 while the second feed circuit 92 is kept open. Here, the first frequency is in the 2.4 GHz band, and the second frequency is in the 5 GHz band.

Figure 2:
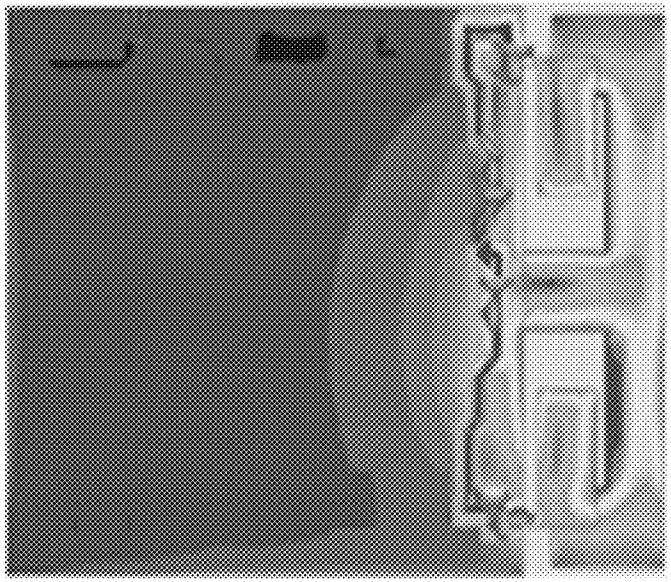
FIG. 2(A) is a diagram illustrating a current distribution when feeding a signal at a first frequency, or a frequency at a low frequency side.
FIG. 2(B) is a diagram illustrating a current distribution when feeding a signal at a second frequency, or a frequency at a high frequency side.
Figure 2:
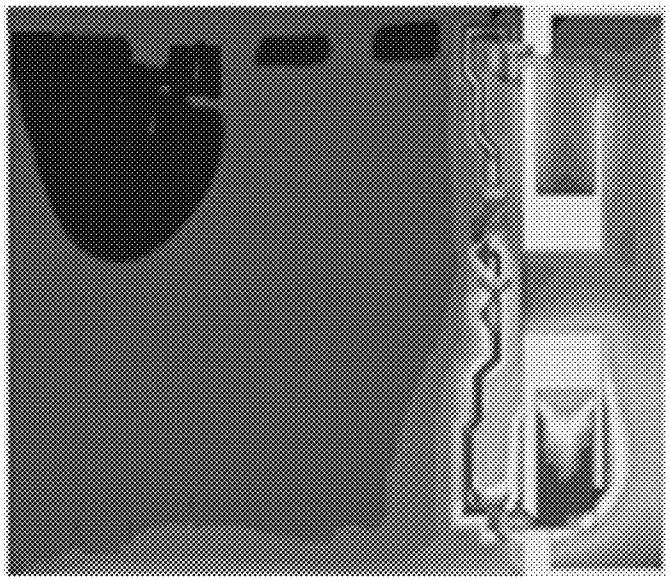

As is evident from FIG. 2, the current is concentrated at the antenna portion, and a current flowing through the ground conductor 2 is relatively small. Note that there are high current intensity portions along a side of the ground conductor 2 (see FIG. 1) near the antenna portion. However, these represent currents flowing through feeding lines that connect the right-side second radiation electrode and the left-side second radiation electrode 22 and corresponding feed circuits. In FIG. 1, these feeding lines are abbreviated. However, FIG. 2 illustrates simulation results of an actual circuit.

Figure 3A:
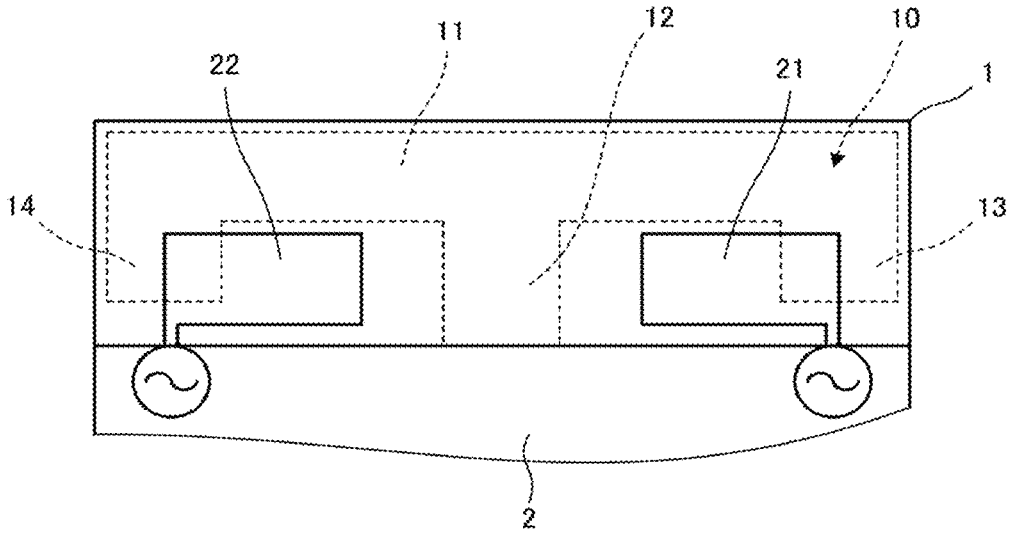
FIG. 3(A) is an enlarged plan view of an antenna portion on a board.
Figure 3B:
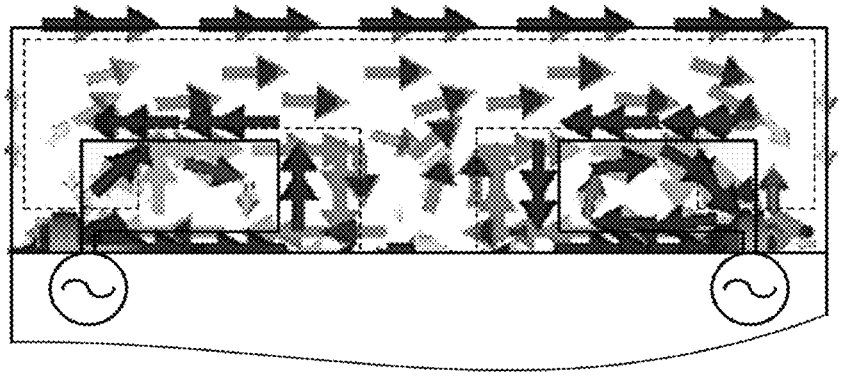
FIG. 3(B) is a diagram illustrating instantaneous intensity and direction of a current flowing through the antenna portion when feeding a signal at the first frequency (2.4 GHz band).

FIG. 3(A) is an enlarged plan view of the antenna portion on the board, and FIG. 3(B) is a diagram illustrating the instantaneous intensity and direction of current flowing through the antenna portion when feeding a signal at the first frequency (2.4 GHz band). As is evident from these figures, the current flows along a path from a side of the ground conductor 2 to the longitudinal electrode 12 of the first radiation electrode 10 to the transverse electrode 11 of the first radiation electrode 10 to the right-side second radiation electrode 21. Further, the current flows along a path from the left-side second radiation electrode 22 to the transverse electrode 11 of the first radiation electrode 10 to the longitudinal electrode 12 of the first radiation electrode 10 to the side of the ground conductor 2.

Note that the stray capacitances CS1 and CS2 act as capacitance components to be loaded between the ground conductor and a portion near the open end of the transverse electrode 11 of the first radiation electrode 10. This enables to cut the length required for the transverse electrode 11 of the first radiation electrode 10, thereby making it possible to downsize the antenna device by that amount.

As is evident from FIG. 2(A), the current in the x direction (width direction) of the ground conductor 2 uniformly forms a current phase and distribution for forward radiation (direction from the ground conductor 2 to the first radiation electrode 10). It is clear from FIG. 2(A) and FIG. 3(B) that, at the first frequency (2.4 GHz band), the right-side second radiation electrode 21 acts as an electrode for capacitive feeding, and the first radiation electrode 10 acts as a half wavelength resonant radiation element. Further, it is clear from FIG. 2(B) that, at the second frequency (5 GHz band), the right-side second radiation electrode 21 acts as a quarter wavelength resonant radiation element.

Figure 4:
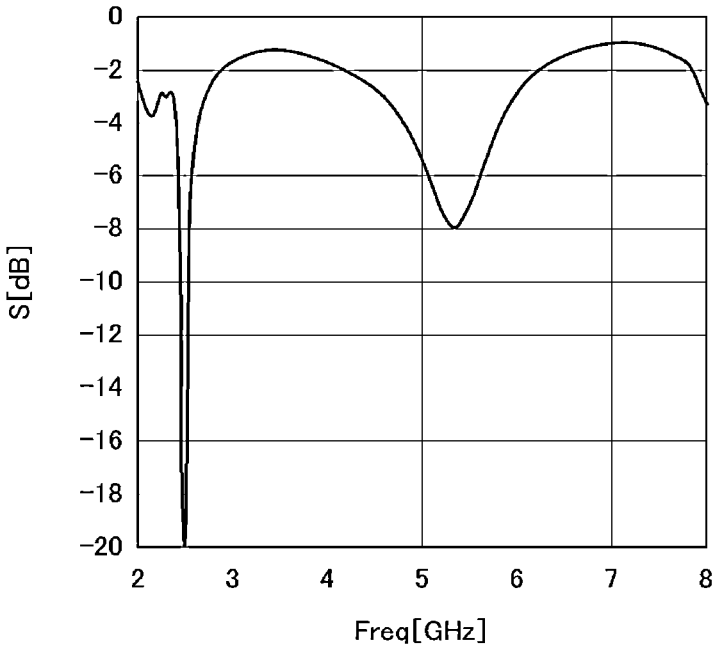
FIG. 4 is a frequency characteristic diagram of return loss (S11 of S parameter) viewed from a feed port of a right-side second radiation electrode 21 for the antenna device inside the communication module 201.

FIG. 4 is a frequency characteristic diagram of return loss (S11 of S parameter) viewed from the feed port of the right-side second radiation electrode 21 for the antenna device inside the foregoing communication module 201. This figure depicts the return loss of about −9.5 dB at 2.45 GHz and about −7 dB at 5.5 GHz. Further, although it is not depicted in FIG. 4, the antenna efficiency is −2.7 dB at 2.45 GHz and −2.8 dB at 5.5 GHz. According to those described above, the antenna device of the communication module 201 operates as a dual band antenna device in the 2.4 GHz band and the 5 GHz band.

As illustrated in FIG. 1, the antenna device inside the communication module 201 has a bilateral symmetrical form. Thus, the current distribution patterns illustrated in FIG. 2(A), FIG. 2(B), and FIG. 3(B) may be reversed left and right when the second feed circuit 92 feeds the left-side second radiation electrode 22 and the first feed circuit 91 is kept open. In this case, the same characteristics are similarly exhibited in the return loss characteristics and the efficiency.

Figure 5A:
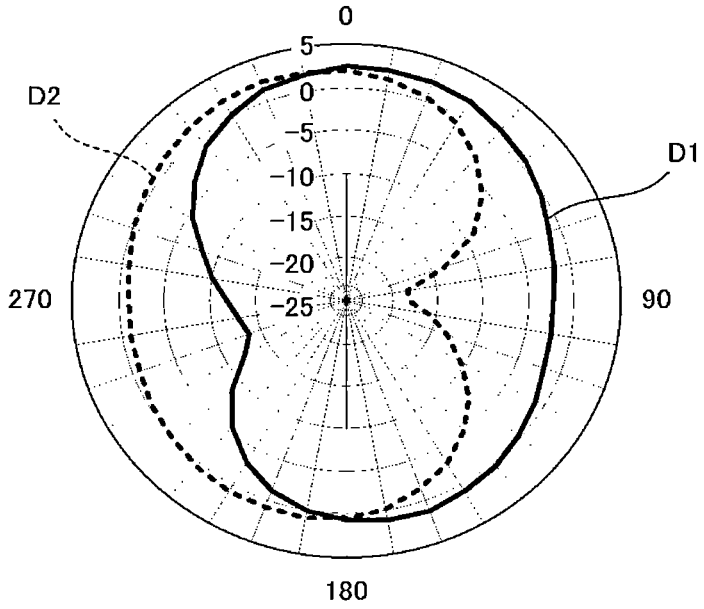
FIG. 5(A) is a diagram illustrating directivity of antenna in an x-y plane in 2.4 GHz band.
Figure 5B:
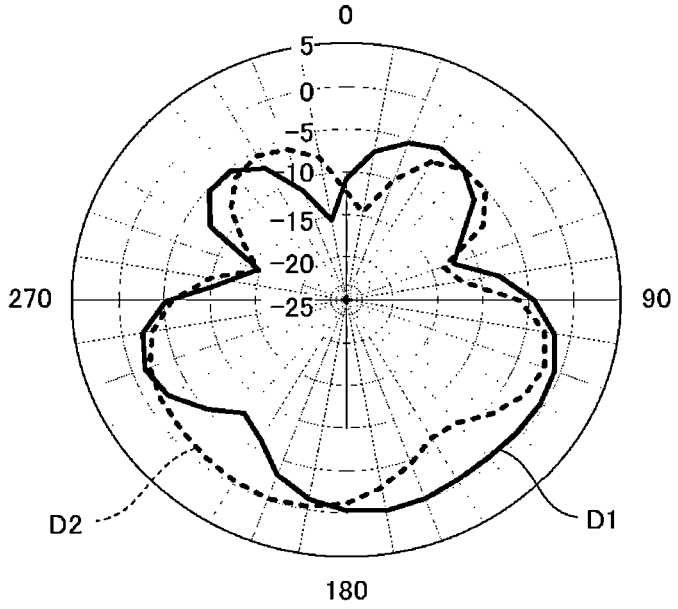
FIG. 5(B) is a diagram illustrating directivity of antenna in the x-y plane in 5 GHz band.

FIG. 5(A) is a diagram illustrating directivity of an antenna in an x-y plane in the 2.4 GHz band, and FIG. 5(B) is a diagram illustrating the directivity of an antenna in the x-y plane in the 5 GHz band. In both figures, D1 denotes the characteristic when the right-side second radiation electrode receives feeding, and D2 denotes the characteristic when the left-side second radiation electrode receives feeding. Further, in both figures, a 0-degree direction is a forward direction (direction from the formation area of the ground conductor 2 to the transverse electrode 11 of the first radiation electrode 10).

As is evident from FIG. 5(A), a stronger directivity in the 0-degree direction (forward direction) appears at 2.4 GHz. It is to be inferred that this is caused by the first radiation electrode 10 acting as a half wavelength resonant radiation element at a location protruding forward from the side of the ground conductor 2 as illustrated in FIG. 2(A). On the other hand, as illustrated in FIG. 5(B), the radiation at 5 GHz is directed not only to the forward direction but also a backward direction. This is caused by the following. The radiation electrodes 21 and 22 operate at $\lambda/4$ (resonate at the quarter wavelength) in the 5 GHz band, a current flows through the ground conductor 2, and the ground conductor 2 also emits radiation.

In the foregoing antenna device of the communication module 201 of the first embodiment, the current is highly excited at the transverse electrode 11 of the first radiation electrode 10. Thus, an intense directivity in the forward direction (direction from the ground conductor 2 to the first radiation electrode 10) is obtained. Further, the antenna device acts as the radiation element in at least two frequency bands according to the first radiation electrode 10, the right-side second radiation electrode 21, and the left-side second radiation electrode 22, making it possible to use it as a dual band antenna.

In the foregoing example, the right-side second radiation electrode 21 is used for feeding. However, when a MIMO system or antenna diversity is configured, both the second radiation electrodes 21 and 22 may be used for feeding by use of both the first feed circuit 91 and the second feed circuit 92.

Second Embodiment

Figure 6:
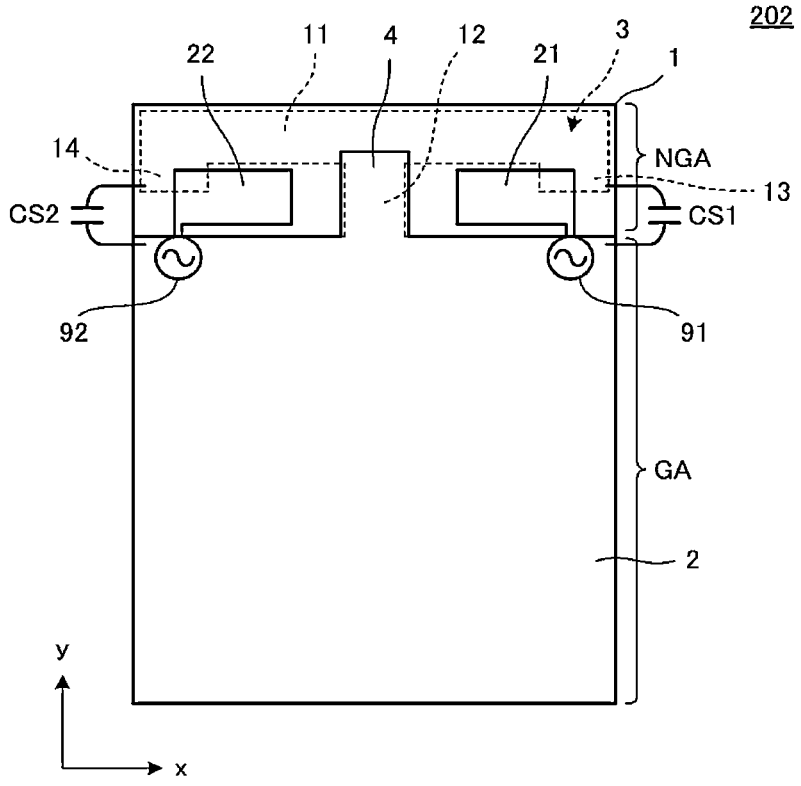
FIG. 6 is a plan view of a communication module 202 according to a second embodiment.

FIG. 6 is a plan view of a communication module 202 according to the second embodiment. An antenna device inside the communication module 202 includes a board 1 that includes a ground conductor formation area GA and a no-ground conductor formation area NGA. This antenna device is different from the antenna device inside the communication module 201 illustrated in FIG. 1 of the first embodiment. This antenna device is provided with a stub 4 extending from the ground conductor 2 to an opposed location opposite to the longitudinal electrode 12 of the foregoing first radiation electrode of the board. No through-hole is formed at opposed locations of the longitudinal electrode 12 and the stub 4. The remaining structure is the same as that of the first embodiment.

Figure 7A:
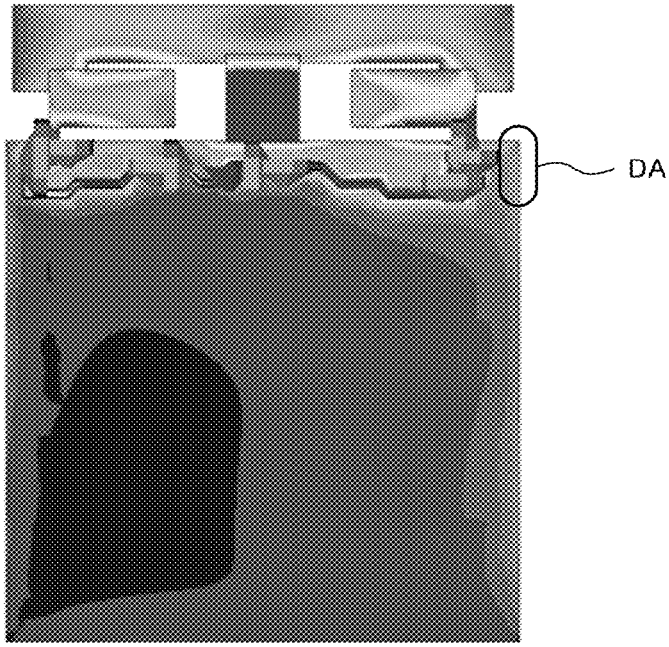
FIG. 7(A) is a diagram illustrating a current distribution for an antenna device inside the communication module 202 when feeding a signal at the second frequency (5 GHz band) to the right-side second radiation electrode 21.
Figure 7B:
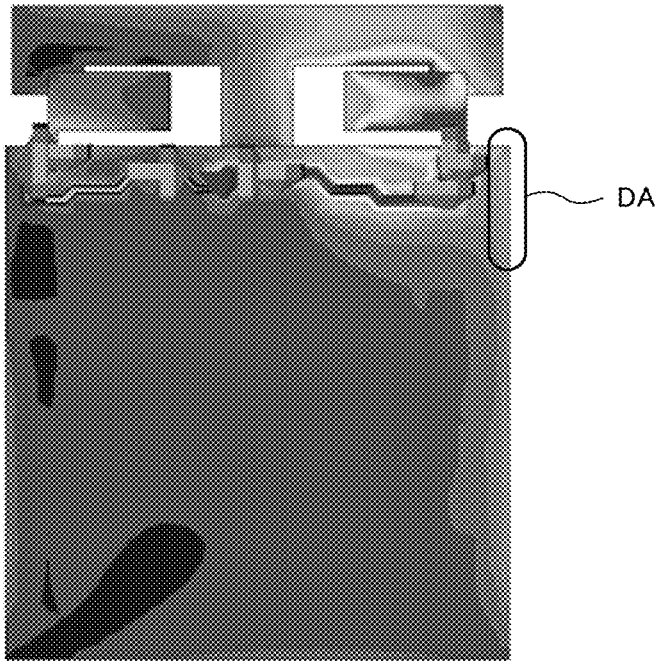
FIG. 7(B) is a diagram illustrating a current distribution when feeding a signal at the second frequency (5 GHz band) to an antenna device in which a stub 4 illustrated in FIG. 6 is not formed (namely, the antenna device illustrated in the first embodiment).

FIG. 7(A) is a diagram illustrating a current distribution for the antenna device inside the foregoing communication module 202 when feeding a signal at the second frequency (5 GHz band) to the right-side second radiation electrode 21. FIG. 7(B) is a diagram illustrating a current distribution when feeding a signal at the second frequency (5 GHz band) to the antenna device in which the stub 4 illustrated in FIG. 6 is not formed (namely, the antenna device illustrated in the first embodiment).

When the stub 4 is formed, the distribution of current (current in the x-axis direction) flowing through the transverse electrode 11 of the first radiation electrode 10 expands. This is because the stub 4 equivalently appears to be high impedance, and the current distribution is reduced in the y-axis direction of the ground conductor 2. When current distribution regions DA surrounded by eclipses in FIG. 7(A) and FIG. 7(B) are compared, it becomes clear that the current distribution in the y-axis direction of the ground conductor 2 is reduced.

Figure 8:
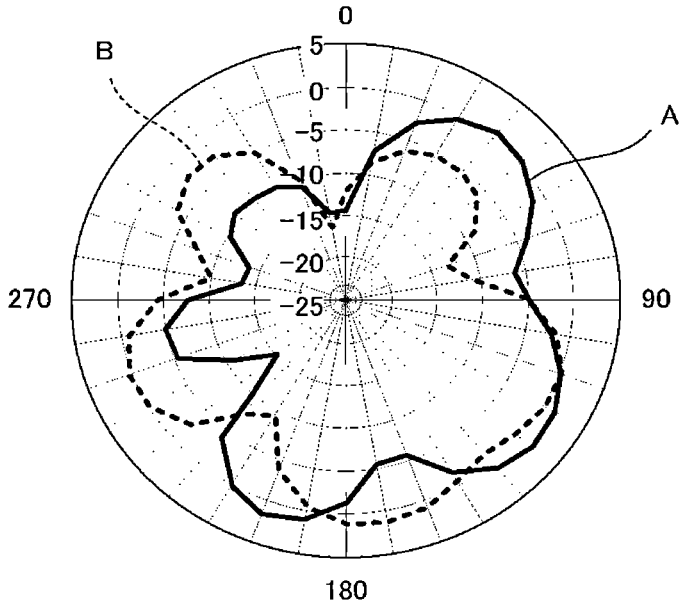
FIG. 8 is a diagram illustrating directivity of antenna in the x-y plane at 5.8 GHz.

FIG. 8 is a diagram illustrating the directivity of antenna in the x-y plane at 5.8 GHz. In FIG. 8, A denotes the characteristic of the antenna device inside the communication module 202 of the present embodiment, and B denotes the characteristic of the antenna device in which the stub 4 illustrated in FIG. 6 is not formed (namely, the antenna device illustrated in the first embodiment). Further, the 0-degree direction is the forward direction (direction from the ground conductor 2 formation area to the transverse electrode 11 of the first radiation electrode 10).

It is to be inferred that a stronger directivity toward the 0-degree direction (forward direction) is obtained because the distribution of the current flowing through the transverse electrode 11 of the first radiation electrode 10 expands when the stub 4 facing to the longitudinal electrode 12 is formed, as described above.

Figure 9:
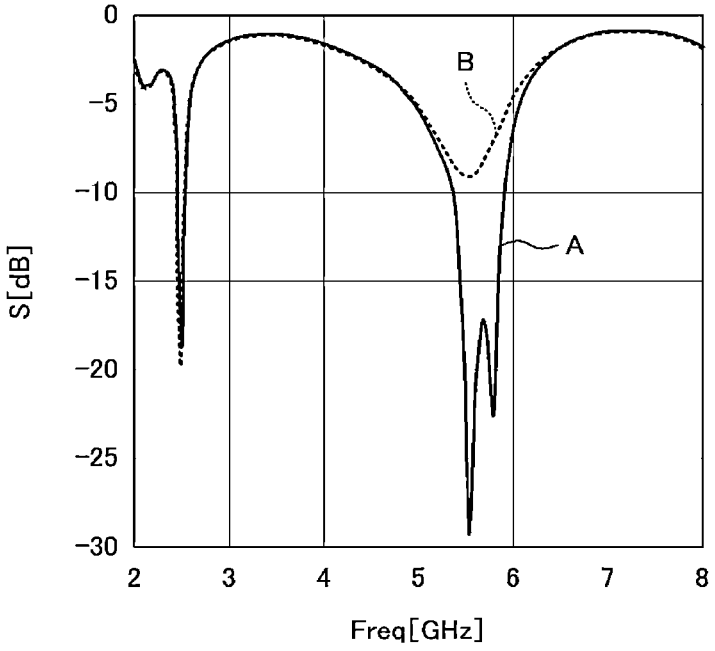
FIG. 9 is a frequency characteristic diagram of return loss viewed from the feed port of the right-side second radiation electrode 21 for the antenna device inside the communication module 202 and the antenna device in which a stub 4 is not formed.

FIG. 9 is a frequency characteristic diagram of return loss (S11 of S parameter) viewed from the feed port of the right-side second radiation electrode 21 for the antenna device inside the foregoing communication module 202 and the antenna device in which the stub 4 is not formed (antenna device illustrated in the first embodiment). It is evident from this figure that the return loss in the 5 GHz band is reduced by providing the stub 4.

According to those embodiments described above, it is clear that the directivity and efficiency in the 5 GHz band are improved in the antenna device of the second embodiment.

Third Embodiment

Figure 10:
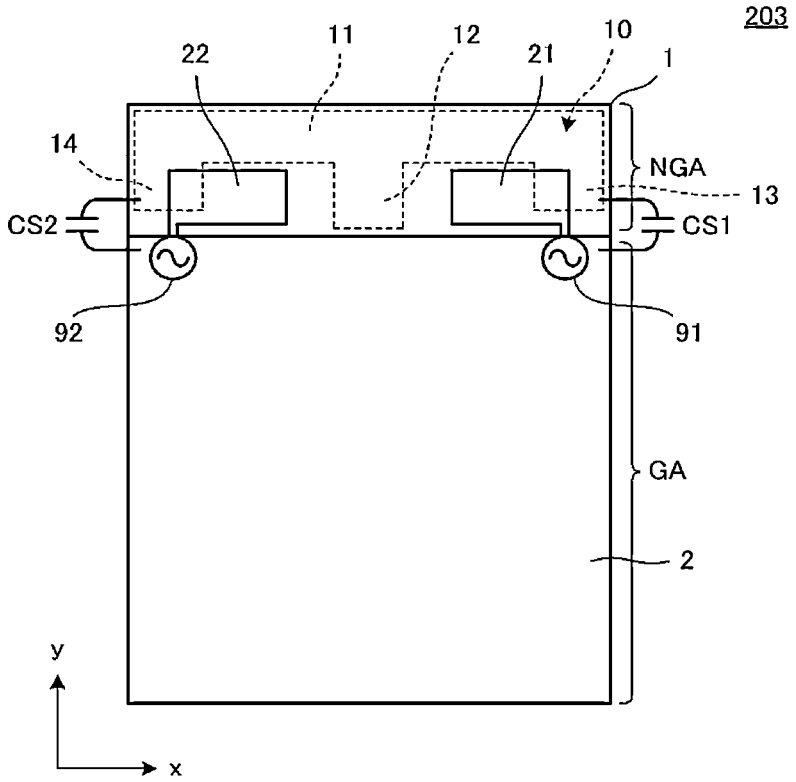
FIG. 10 is a plan view of a communication module 203 including an antenna device according to a third embodiment.

FIG. 10 is a plan view of a communication module 203 including an antenna device according to the third embodiment. The communication module 203 includes a board 1 that includes a ground conductor formation area GA and a no-ground conductor formation area NGA. A first radiation electrode 10 is formed on the bottom surface of the no-ground conductor formation area NGA of the board 1, and a right-side second radiation electrode 21 and a left-side second radiation electrode 22 are formed on the top surface of the no-ground conductor formation area NGA.

This antenna device is different from the communication module 201 illustrated in FIG. 1 of the first embodiment in that the longitudinal electrode 12 of the first radiation electrode and the ground conductor 2 are not directly electrically continuous. A slit is formed in between the longitudinal electrode 12 of the first radiation electrode and the ground conductor 2 (ground conductor 2 on a back surface side of the board 1). This slit has a gap of, for example, 0.5 mm.

Figure 11:
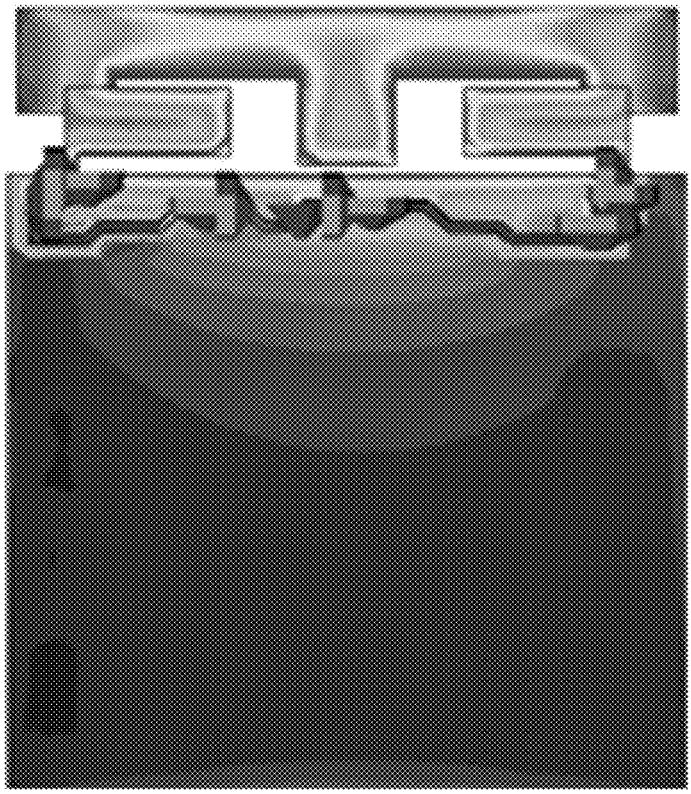
FIG. 11 is a diagram illustrating a current distribution when feeding a signal at the first frequency (2.4 GHz).

FIG. 11 is a diagram illustrating the current distribution when feeding a signal at the first frequency (2.4 GHz). As is evident from FIG. 11, the intensity of the current flowing through the transverse electrode 11 of the first radiation electrode 10 is larger as a whole, compared with that of the first embodiment. The current intensity also increases at a front side. Further, the current flowing through the ground conductor 2 is smaller compared with that of the first embodiment.

Figure 12:
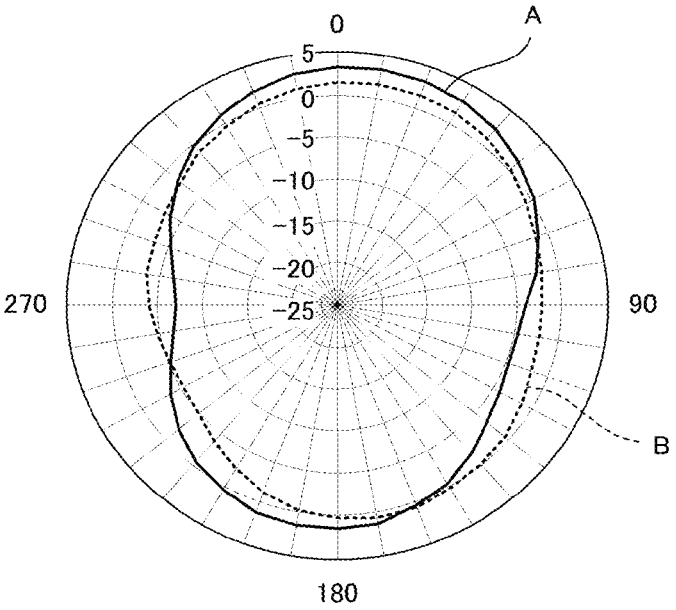
FIG. 12 is a diagram illustrating directivity of antenna in the x-y plane in the 2.4 GHz band.

FIG. 12 is a diagram illustrating the directivity of antenna in the x-y plane in the 2.4 GHz band. Here, A denotes the characteristic of the antenna device of the present embodiment, and B denotes the characteristic of the antenna device (illustrated in the first embodiment) in which the foregoing slit is not formed.

As is evident from FIG. 12, forming the slit in between the longitudinal electrode 12 of the first radiation electrode and the ground conductor 2 further strengthens the directivity toward the forward direction. Although this is not clearly illustrated in FIG. 11, it is to be inferred that this is due to less downward expansion of the current flowing to the ground conductor.

Figure 13:
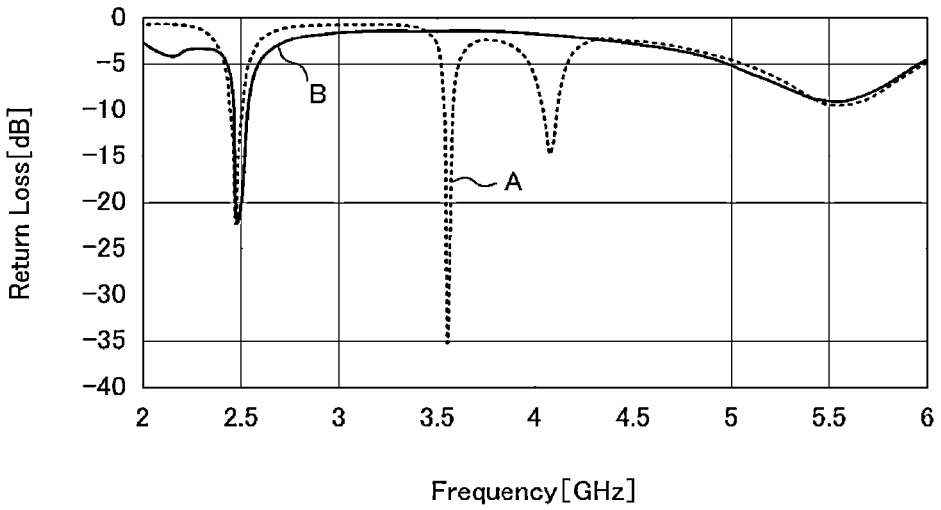
FIG. 13 is a frequency characteristic diagram of return loss viewed from the feed port of the right-side second radiation electrode 21 for the antenna device inside the communication module 203 and an antenna device in which no slit is formed.

FIG. 13 is a frequency characteristic diagram of return loss (S11 of S parameter) viewed from the feed port of the right-side second radiation electrode 21 for the antenna device inside the foregoing communication module 203 and the antenna device in which the foregoing slit is not formed (antenna device illustrated in the first embodiment). It is evident from this figure that the return loss is sufficiently reduced in the 2.4 GHz band and the 5 GHz band even when the foregoing slit is formed. Here, in this example, the return loss is also reduced near at 3.5 GHz and 4 GHz as a result of secondary action caused by the slit formation.

Figure 14:
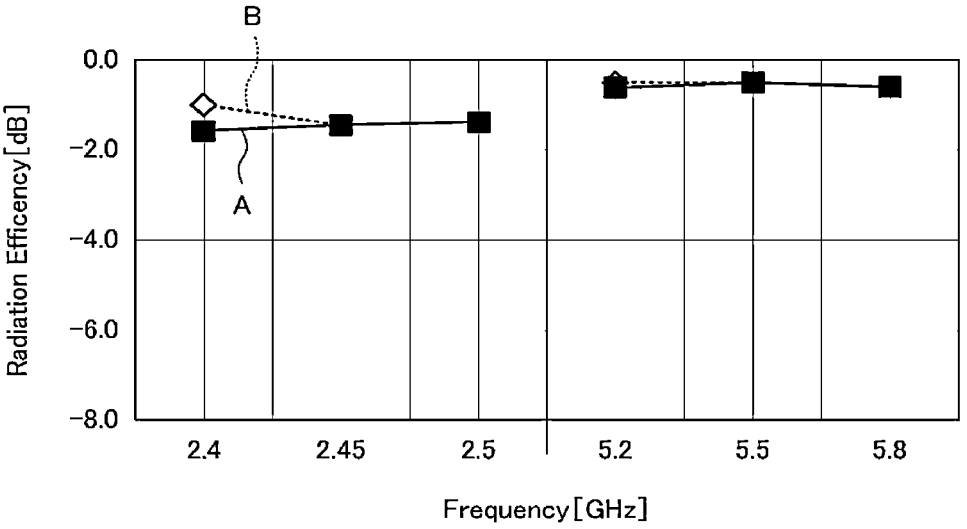
FIG. 14 is a diagram illustrating antenna efficiency at the first frequency (2.4 GHz band) and the second frequency (5 GHz band).

FIG. 14 is a diagram illustrating the antenna efficiency at the first frequency (2.4 GHz band) and the second frequency (5 GHz band). It is evident from this figure that the efficiency does not change substantially and preferable characteristics are obtained even when the foregoing slit is formed.

Note that, according to the third embodiment, a capacitance formed at the slit in between the longitudinal electrode 12 of the first radiation electrode and the ground conductor 2 is loaded onto the first radiation electrode 10. This helps to decrease the half wavelength resonant frequency of the first radiation electrode 10. Thus, downsizing by that amount may be achieved. Further, even when noise generated from a circuit formed at the ground conductor formation area or internal noise of an electronic apparatus, in which the communication module 103 is stored, is superposed at the ground conductor, a radiation of such noise may be suppressed.

Fourth Embodiment

Figure 15:
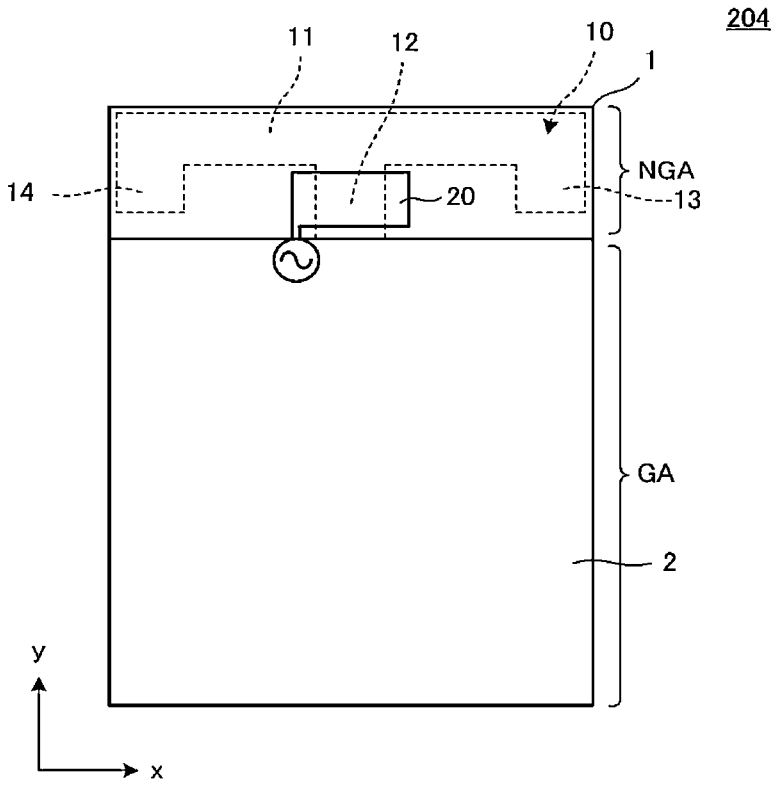
FIG. 15 is a plan view of a communication module 204 including an antenna device according to a fourth embodiment.

FIG. 15 is a plan view of a communication module 204 including an antenna device according to the fourth embodiment. The communication module 204 includes a board 1 that includes a ground conductor formation area GA and a no-ground conductor formation area NGA. A first radiation electrode 10 is formed on the bottom surface of the no-ground conductor formation area NGA of the board 1, and a second radiation electrode 20 is formed on the top surface of the no-ground conductor formation area NGA.

This antenna device is different from the first, second, and third embodiments in that the second radiation electrode 20 is formed as a single unit and arranged at a location in such a way that a capacitance is formed between the second radiation electrode 20 and the longitudinal electrode 12 of the first radiation electrode 10.

When a MIMO system or antenna diversity is not configured, the second radiation electrode 20 may be formed as a single unit as described above. Further, a location at which the capacitive feeding is performed for the first radiation electrode 10 may be at a center such as illustrated or near the center.

Note that, in the first to third embodiments, examples provided with two units of the second radiation electrodes are described. However, when a MIMO system or antenna diversity is not configured, the antenna device may be configured to include a single unit of the first radiation electrode 10 and a single unit of the second radiation electrode by forming only one of the two units of the second radiation electrodes in the first to third embodiments.

Fifth Embodiment

In the fifth embodiment, a structure of an electronic apparatus including the communication module of the first or second embodiment is described.

Figure 16:
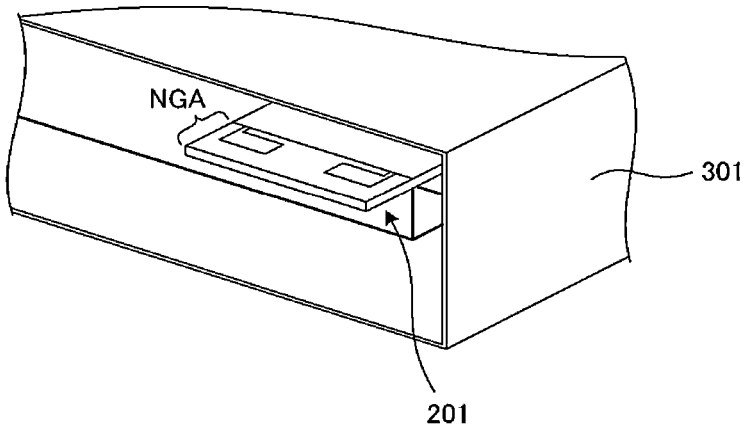
FIG. 16 is a partial perspective diagram of an electronic apparatus that serves as a fifth embodiment and is in a state where a front panel thereof is removed.
Figure 17A:
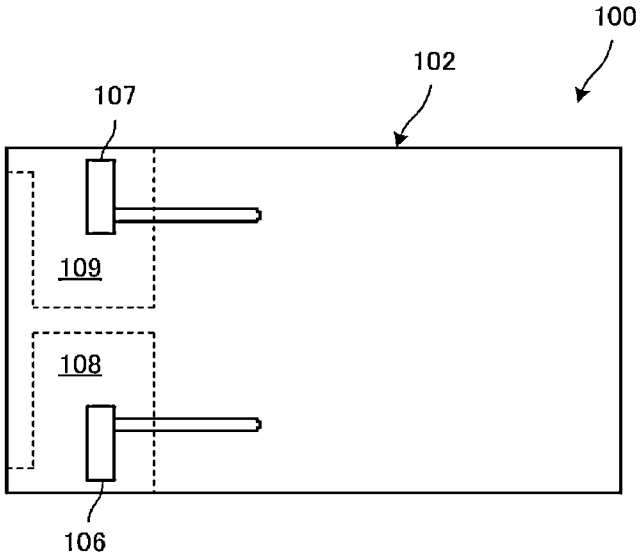
FIG. 17(A) PRIOR ART
FIG. 17(A) is a plan view of an antenna device 100 described in Japanese Unexamined Patent Application Publication No. 2006-74446.
Figure 17B:
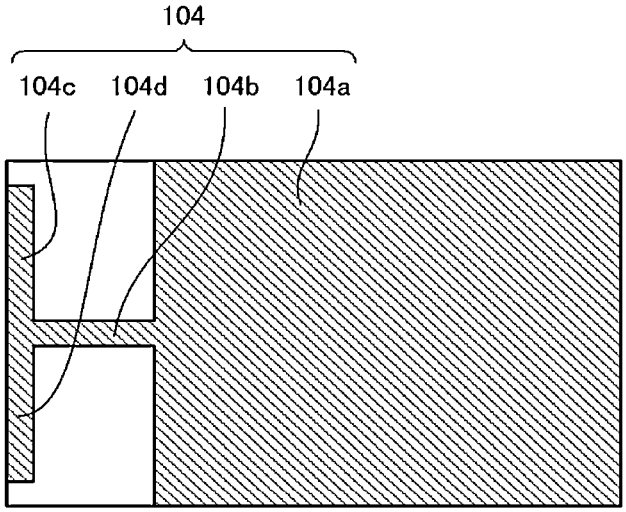
FIG. 17(B) PRIOR ART
FIG. 17(B) is a bottom view thereof.

FIG. 16 is a partial perspective diagram of an electronic apparatus (for example, video recorder) that serves as the fifth embodiment in a state where a front panel thereof is removed. The antenna portion of the communication module 201 and, in particular, the no-ground conductor formation area NGA are facing toward the forward direction. The communication module 201 is mounted on a module fitting metal plate of the electronic apparatus by screwing or the like.

Here, the communication module 201 including the antenna device is mounted inside a casing of the electronic apparatus 301 as described above. This enables performing high gain communication with a communication counterpart apparatus placed in front of the electronic apparatus 301.

Note that, in each embodiment, the stray capacitances CS1 and CS2 are formed by extending both end portions of the transverse electrode 11 of the first radiation electrode 10 toward a direction approaching closer to the side of the ground conductor 2. Further, in each embodiment, the capacitances are formed by sandwiching a base material of the board 1 between both end portions of the transverse electrode 11 and the right-side second radiation electrode 21 and the left-side second radiation electrode 22. Alternatively, the transverse electrode 11 of the first radiation electrode 10 may have a straight line shape (rectangular shape). In other words, forming the stray capacitances CS1 and CS2 are not essential.

Further, in each embodiment, the first radiation electrode and the second radiation electrode are formed on the opposite surfaces of the board. Alternatively, the first and second radiation electrodes may be formed on the same surface of the board.

The invention claimed is:

1. An antenna device including a board having a ground conductor formation area in which a ground conductor is formed and a no-ground conductor formation area in which no ground conductor is formed, said antenna device comprising a first radiation electrode and a second radiation electrode in the no-ground conductor formation area, the first radiation electrode being T-shaped and including a transverse electrode extending in a first direction and a longitudinal electrode protruding from a point between two end portions of the transverse electrode in a direction orthogonal to the first direction, the second radiation electrode being arranged near the transverse electrode of the first radiation electrode, the first radiation electrode having a length configured to operate as a radiation element for radiating a signal at a first frequency, the longitudinal electrode of the first radiation electrode being electrically continuous with the ground conductor or facing the ground conductor over a slit, the first radiation electrode being disposed at a location so that a capacitance is formed between the ground conductor and an end portion of a transverse electrode of the first radiation electrode, the second radiation electrode having a length configured to operate as a radiation element for radiating a signal at a second frequency which is higher than the first frequency, the second radiation electrode being connected to a feed port, and the second radiation electrode forming a capacitance with the first radiation electrode and performing capacitive feeding of a signal at the first frequency for the first radiation electrode.

2. The antenna device according to claim 1, wherein the first radiation electrode is formed on a first surface of the board, and the second radiation electrode is formed on a second surface thereof.

3. The antenna device according to claim 1, wherein a stub extending from the ground conductor is formed on a surface of the board opposite to the first radiation electrode.

4. The antenna device according to claim 1, wherein the second radiation electrode is disposed at a location so that a capacitance is formed between the second radiation electrode and the longitudinal electrode of the first radiation electrode.

5. The antenna device according to claim 1, wherein the no-ground conductor formation area includes two units of the second radiation electrode, and the two units of the second radiation electrode are connected to individual feed ports, the two units of the second radiation electrode each form a capacitance with the first radiation electrode, and each perform capacitive feeding of the signal at the first frequency for an end portion of the transverse electrode of the first radiation electrode.

6. An electronic apparatus including the antenna device according to claim 1, wherein the antenna device is stored inside the electronic apparatus so that a direction from the ground conductor formation area to the transverse electrode of the first radiation electrode matches a forward direction of the electronic apparatus.

* * * * *